US011549293B1

(12) United States Patent
Lawrence

(10) Patent No.: US 11,549,293 B1
(45) Date of Patent: Jan. 10, 2023

(54) THREADED PIVOT BAR AND METHOD

(71) Applicant: Barry G. Lawrence, Trinity, NC (US)

(72) Inventor: Barry G. Lawrence, Trinity, NC (US)

( * ) Notice: Subject to any disclaimer, the term of this patent is extended or adjusted under 35 U.S.C. 154(b) by 330 days.

(21) Appl. No.: 16/681,327

(22) Filed: Nov. 12, 2019

(51) Int. Cl.
*E05D 15/22* (2006.01)
*E05D 7/06* (2006.01)

(52) U.S. Cl.
CPC ..... *E05D 15/22* (2013.01); *E05D 7/06* (2013.01); *E05Y 2900/148* (2013.01)

(58) Field of Classification Search
CPC ..... E05D 13/08; E05D 15/22; E05D 7/06; E05D 15/58; E05D 2015/586; E06B 3/50; E06B 3/5063
USPC ..... 49/181, 176
See application file for complete search history.

(56) References Cited

U.S. PATENT DOCUMENTS 690,417 A * 1/1902 Golden ..... E06B 3/50 49/176
1,105,199 A * 7/1914 House ..... E06B 3/5063 49/181
2,067,164 A * 1/1937 Smith ..... E05D 13/1253 49/429
3,126,588 A * 3/1964 Osten ..... E05D 13/1207 49/181
3,348,335 A * 10/1967 Mauro ..... E06B 3/50 49/431
3,349,518 A * 10/1967 Johnson ..... E04C 3/28 49/446
3,445,964 A * 5/1969 Foster ..... E06B 3/50 49/446
4,227,345 A * 10/1980 Durham, Jr. ..... E05D 15/22 49/181
4,363,190 A * 12/1982 Anderson ..... E05D 15/22 49/446
4,555,868 A * 12/1985 Mancuso ..... E06B 3/50 49/504
4,581,850 A * 4/1986 Simpson ..... E05D 15/22 49/446
4,590,708 A * 5/1986 Campodonico ..... E05D 15/22 49/181
4,640,048 A * 2/1987 Winner ..... E05D 15/22 403/402
4,644,691 A * 2/1987 Wright ..... E05D 15/22 49/181
4,683,676 A * 8/1987 Sterner, Jr. ..... E05D 13/1253 49/176

(Continued)

*Primary Examiner* — Justin B Rephann
(74) *Attorney, Agent, or Firm* — Tuggle Duggins P.A.; Blake P. Hurt

(57) ABSTRACT

A pivot bar in the nature of a screw with a head and a threaded portion for lateral adjustment at the site of a window installation is provided. A receiver is integrally formed in the bottom rail of a window sash, the receiver defined as a channel sized and shaped to frictionally engage with the threaded portion of the screw to structurally support the pivot bar during use. The pivot bar is rotatably engaged to position the threads within the receiver and laterally adjusted relative to the distance between the window sash and the window jamb such that the screw head mates with the pivot bar shoe associated in the corresponding window jamb, accounting for any measuring variances between the window jamb and the window sash. A method of installing a laterally adjustable pivot bar is also provided.

11 Claims, 2 Drawing Sheets

(56) References Cited

U.S. PATENT DOCUMENTS 4,718,194 A * 1/1988 FitzGibbon ..... E05D 13/1207 49/181
4,763,445 A * 8/1988 Silverman ..... E05D 15/22 49/176
4,926,524 A 5/1990 Owens
5,069,001 A 12/1991 Makarowski
5,157,808 A * 10/1992 Sterner, Jr. ..... E05D 15/22 267/156
5,237,775 A * 8/1993 Hardy ..... E05D 15/22 49/181
5,353,548 A * 10/1994 Westfall ..... E05D 15/22 49/446
5,371,971 A * 12/1994 Prete ..... E05D 15/22 49/181
5,671,566 A * 9/1997 Tix ..... E06B 3/44 49/419
5,704,165 A 1/1998 Slocomb et al.
5,855,092 A * 1/1999 Raap ..... E05D 15/22 49/181
6,058,653 A 5/2000 Slocomb et al.
6,178,695 B1 * 1/2001 Kornegay ..... E06B 3/5063 49/176
6,523,307 B2 * 2/2003 Prete ..... E05D 13/1207 49/181
6,550,184 B1 * 4/2003 O'Donnell ..... E05D 15/22 49/176
6,658,794 B1 * 12/2003 Hansel ..... E05D 15/22 49/176
6,857,228 B2 * 2/2005 Kunz ..... E05D 15/22 49/181
9,097,061 B1 * 8/2015 Lawrence ..... E05D 5/00
10,563,440 B2 * 2/2020 Kellum ..... F16F 1/12
2003/0121207 A1 7/2003 O'Donnell et al.
2008/0178425 A1 * 7/2008 Tuller ..... E05D 13/1276 16/197

* cited by examiner

THREADED PIVOT BAR AND METHOD

FIELD OF THE INVENTION

The invention herein pertains to window hardware generally, and particularly pertains to a threaded pivot bar that is laterally adjustable during installation without weakening the corner of an extruded window.

DESCRIPTION OF THE PRIOR ART AND OBJECTIVES OF THE INVENTION

The use of single and double sash, pivotable windows is known in the art. One of the reasons for these windows' increasing popularity is their ease of use and maintenance, particularly as it relates to cleaning. Generally, the window is constructed with one or more sashes each formed by a pair of stiles connected to header and base rails. The sash rides vertically within a pair of opposingly oriented window jambs. Historically, it was only the respective edges of the windows that traveled within the jamb(s), but modern windows have utilized significant hardware to make these windows more user-friendly. Structures known as pivot bars may be attached to the windows that, when properly mated with a component known as a pivot bar shoe, allow a portion of the window to rotate from its substantially vertical posture to a substantially more horizontal configuration, convenient for cleaning activities. While the convenience of these windows as acknowledged, it does not come without certain challenges. The manufacture of the modern window is often performed far from the site of the window's installation, and while many tolerances can be engineered into the window's construction, these tolerances must have limits or the window ceases to function. The conventional approach to installing a pivot bar is to bore a hole in the corner of the window sash sidewall, which facilitates the insertion of the pivot bar member, but which may structurally weaken the window, particularly during inclement weather or when resisting unauthorized entry, two circumstances where it would be highly undesirable for a window to inadvertently rotate into the horizontal posture described above. Even when the window performs as desired, variations in the installation site, particularly the distance between a sash sidewall and the window jamb which generally corresponds to the distance between the pivot bar and the associated shoe, can vary dramatically. There is little that can be done if the pivot bar and shoe don't match up, and replacement windows can cost both time and money.

Thus, in view of the problems and disadvantages associated with prior art pivot bars, the present invention was conceived and one of its objectives is to provide a pivot bar that is adjustable onsite, during the window installation.

It is another objective of the present invention to provide a pivot bar that is laterally adjustable relative to the distance between the window jamb and the window sash side wall.

It is still another objective of the present invention to provide a pivot bar with a receiver defined within the window sash rail.

It is yet another objective of the present invention to provide a pivot bar that is easy to manufacture and simple to install.

It is a further objective of the present invention to provide a pivot bar in the nature of a screw that is rotatably engaged to laterally adjust the head of the screw to ensure proper mating with the associated pivot bar shoe.

It is still a further objective of the present invention to provide a pivot bar screw with an associated pivot bar shoe orienting the screw head towards the rear.

It is yet a further objective of the present invention to provide a method of installing a pivoting window sash including the steps of defining a receiving channel within the window rail, introducing a screw with an oversized head relative to the shaft configured (i.e. sized and shaped) to mate with a pivot bar shoe installed within a window jamb, rotatably engaging the screw to an orientation with the threads seated within the receiver, and laterally adjusting the screw such that the screw head mates with the pivot bar shoe, whereby the screw and shoe travel vertically within the window jamb and facilitate the rotation of the sash out of the jamb as desirable.

Various other objectives and advantages of the present invention will become apparent to those skilled in the art as a more detailed description is set forth below.

SUMMARY OF THE INVENTION

The aforesaid and other objectives are realized by providing a pivot bar in the nature of an elongated screw with an oversized head relative to the screw shaft, for example a screw defining a length of five inches (12.7 cm) with a head diameter of three quarters (¾) of an inch (1.91 cm). A receiver is integrally formed in the bottom rail of a window sash, the receiver defined as a channel sized and shaped to frictionally engage with the threaded portion of the screw to structurally support the same. The pivot bar is rotatably engaged to position the threads within the receiver and laterally adjusting the screw such that the screw head mates with the pivot bar shoe associated in the corresponding window jamb, accounting for any measuring variances between the window jamb and the window sash. Specifically, the oversized pivot bar screw head passes laterally beyond the pivot bar shoe and into the void behind the pivot bar shoe, permitting the positioning of the pivot bar shoe brake to be located in the front of the pivot bar shoe as desirable. A method of installing a threaded pivot bar is also included.

DETAILED DESCRIPTION OF THE PREFERRED EMBODIMENT AND OPERATION OF THE INVENTION

Figure 1:
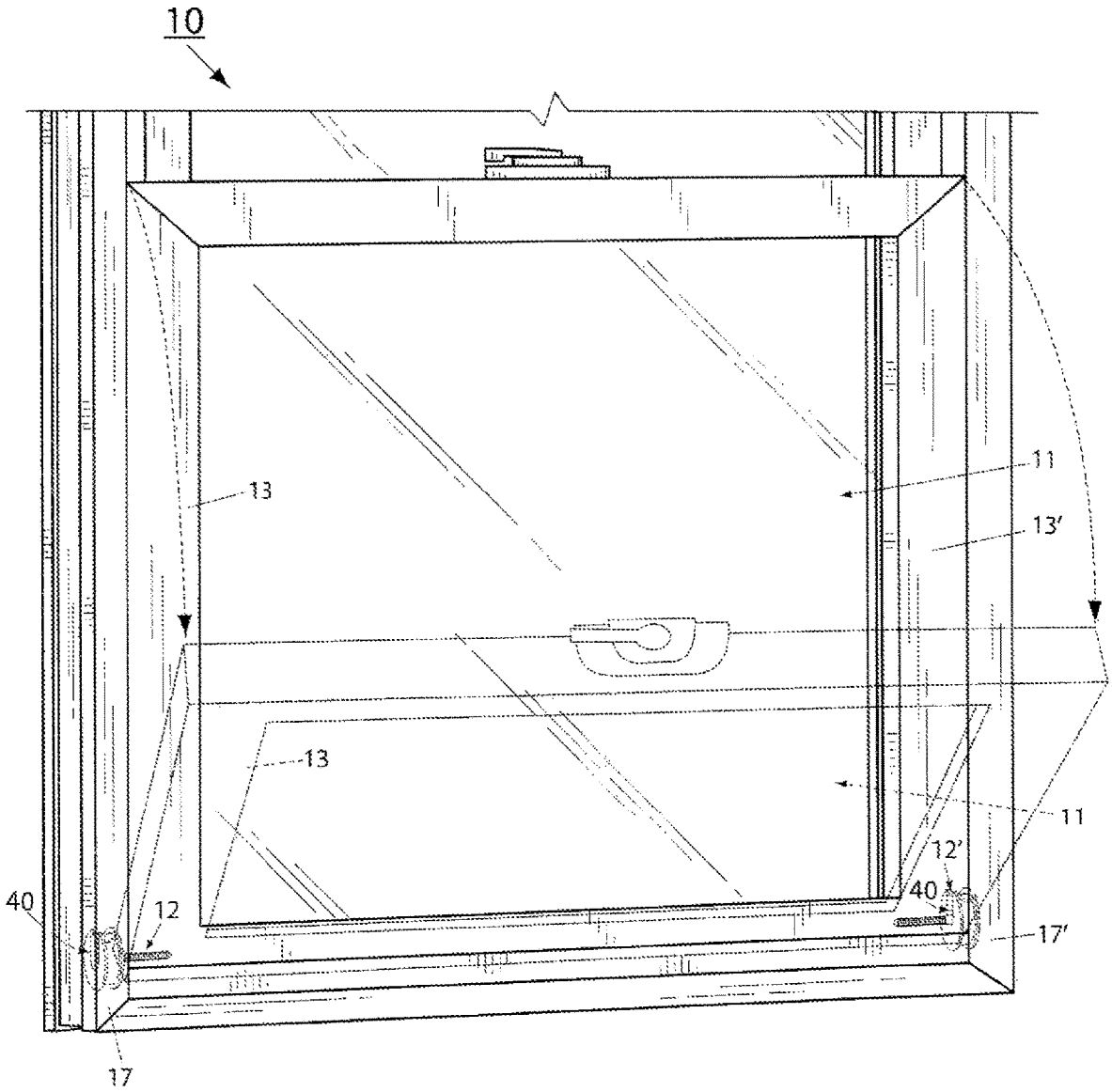
FIG. 1 shows a side perspective view of a rotatable window sash, with the horizontal posture indicated in dotted fashion.
Figure 2:
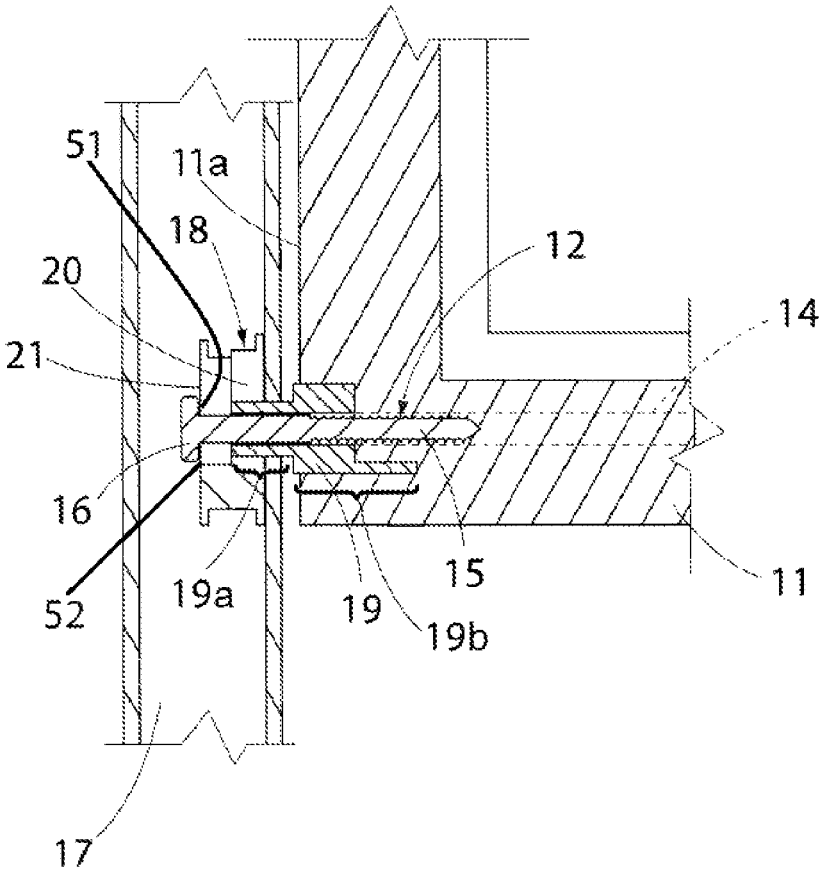
FIG. 2 pictures a cut-away side elevational view of the pivot bar as installed in a window sash.

For a better understanding of the invention and its method of use, turning now to the drawings, FIG. 1 illustrates a conventional double hung window 10 with lower sash 11 shown in both vertical (solid) and tilted (dashed line) positions. To permit tilting, preferred pivot bar 12 as seen in FIGS. 1 and 2 is employed in stiles 13, 13' of sash 11 (only one pivot bar shown in FIG. 2, it being understood that the same structure and function may apply equally to the opposing side). In order to install conventional pivot bars, a drill is used to form an opening and then the pivot so bar is inserted therein (see for example U.S. Pat. No. 9,097,061 owned by the instant applicant and incorporated by reference herein in its entirety). Unlike the cited prior art, preferred sash 11, specifically the bottom portion known as the rail, does not include a hollow void to receive pivot bar 12 therein. Instead, sash 11 defines receiver 14, ideally integrally formed therein. In one embodiment, sash 11 is extruded from a polymeric material such as vinyl. It is preferable that receiver 14 defines a length stretching all or substantially all the way across lower sash 11. While a mechanical receiver installed within sash 11 may functionally similarly, such is disfavored for the same reason conventional pivot bars are problematic: they are routinely installed in locations other than the window installation site, leading to inefficient installation and operation.

In the preferred embodiment, pivot bar 12 is defined as a threaded member in the nature of a screw, including threaded portion 15 and head 16. In order to function as a pivot bar, that is to say to facilitate the rotation of window sash 11 in and out of window jambs 17, 17' from a substantially vertical posture to a decidedly more horizontal posture, threaded portion 15 may be rotated into and through receiver 14. As demonstrated in FIG. 2, threaded portion 15 of pivot bar 12 passes through the sidewall of sash 11 and frictionally engages the interior surface of receiver 14 formed therein. In the preferred embodiment, the diameter (or other appropriate internal measurement) of receiver 14 is slightly less than the diameter (or other appropriate exterior measurement) of threaded portion 15, requiring frictional engagement and material displacement between receiver 14 and threaded portion 15. In this manner, the engagement surface area with preferred pivot bar 12 is substantially greater than the conventional pivot bars known in the art, which typically only engage a small portion of the sidewall surface of lower sash 11, typically measured in thousandths of an inch. In the preferred embodiment, receiver 14 defines a length of at least six inches (15.24 cm), which in turn will accommodate the threaded portion 15 of pivot bar 12 measuring three inches or more. More preferably is an embodiment of receiver 14 and threaded portion 15 that defines a length of at least twelve inches (30.48 cm). Although the shape of receiver 14 is not intended as a limitation, preferred embodiments include circular and square tubular cross-sectional shapes.

Preferred pivot bar 12 also includes a head 16 that is sized and shaped to be received within an associated pivot bar shoe 18 positioned in the window jamb 17 in opposing relation to pivot bar 12 as demonstrated in FIG. 2. The structure of window pivot bar shoe 18 generally includes a base 19 which may serve as the mounting substrate for rotatable cam 20. In an embodiment, the base 19 defines two portions, a first portion 19*a* is disposed within the window jamb 17 and a second portion 19*b* is disposed within the window sash 11. Said cam includes a central orifice 40 sized and shaped to receive the head of a pivot bar therein, in the instant invention meaning head 16 of pivot bar 12. When lower sash 11 is raised, pivot bar shoe 18 travels vertically within jamb 17 by virtue of its contact with pivot bar 12. In this manner, it is critically important that the distance between pivot bar 12 and pivot bar shoe 18 results in the proper mating between cam 20 and pivot bar head 16 to facilitate the rotatable engagement of window sash 11 as desirable. In the preferred embodiment, pivot bar shoe 18 additionally includes brake 21 circumscribing cam 20 to slow and/or stop over-rotation of cam 20. In one example, brake 21 prevents cam 20 from rotating more than thirty (30) degrees. In an alternate embodiment, brake 21 prevents minute rotation of cam 20, requiring firm, intentional rotation of cam 20 via pivot bar 12 to effectuate the rotation of sash 11. Conventionally, brake 21 is positioned distally of cam 20 relative to pivot bar 12 (i.e. positioned at the rear or back of pivot bar shoe 18), but due to the adjustable nature of threaded pivot bar 12 and head 16, head 16 may actually be positioned past the typical orientation of a pivot bar and affiliated shoe. By positioning head 16 beyond cam 20, it can travel in the void defined in window jamb 17, which permits brake 21 to be located proximally of cam 20 relative to pivot bar 12 (i.e. positioned at the front of pivot bar shoe 18) which eases replaceability and may be more preferable from a functionality standpoint than the conventional configuration. In a preferred embodiment, the head 16 is positioned a distance from the window sash 11 so as to form a space therebetween, and the brake 21 and rotatable cam 20 are positioned along the pivot bar 12 between the head 16 and sash 11, wherein a bottom surface 51 of the head 16 that faces a surface 11*a* of the window sash 11 nearest the head 16 is configured to contact a surface 52 of the pivot bar shoe 18 that is most distal from the surface 11*a* of the window sash 11. The surface 11*a* of the window sash 11, the bottom surface 51 of the head 16, and the surface 52 of the pivot bar shoe 18 are all configured to be parallel with one another.

While threaded pivot bar 12 functions as described above, it may be preferable to dispose trigger 21 within receiver 14. Trigger 21 preferable defines a central orifice sized and shaped to receive at least a portion of threaded shaft 15 therethrough. Preferred trigger 21 also includes an extending portion with cooperative geometry relative to pivot bar shoe 18 generally, and cam 20 specifically. As would be understood, conventional embodiments of one or both of pivot bar head 16 and cam 20 are annular in nature, and certain circumstances may arise wherein the rotation of pivot bar head 16 does not efficiently translate rotational torque to cam 20, resulting in the desirable pivoting of lower sash 11. Therefore, the preferred embodiment of trigger 21 is a block structure, ideally square in cross-section, that will frictionally engage the inner surface of cam 20 and effectuate the rotational transference from lower sash 11 via pivot bar 12 to pivot show 18 via cam 20. The preferred embodiment of the aforementioned central orifice may similarly be threaded so as to facilitate the lateral adjustability of threaded pivot bar 12.

A method of installing a laterally adjustable pivot bar is also included. The preferred steps include providing a threaded pivot bar 12 comprised of threaded portion 15 and head 16 and a window sash including receiver 14 formed therein. The pivot bar 12 is rotatably engaged to position the threaded portion 15 within the receiver 14 and laterally adjusting the pivot bar such that the screw head 16 mates with the pivot bar shoe 18 associated in the corresponding window jamb 17, accounting for any measuring variances between the window jamb 17 and the window sash 11.

The illustrations and examples provided herein are for explanatory purposes and are not intended to limit the scope of the appended claims.

I claim:

1. A pivot bar configured for lateral adjustment between a window sash and a window jamb, the pivot bar comprising a threaded portion continuous with a head, wherein the pivot bar is configured to travel up and down within the window jamb and the threaded portion frictionally engages a receiver within the window sash, and wherein a position of the head is adjustable by rotating the threaded portion while the window sash is in a fixed position; wherein the head is adjustable to directly contact a pivot bar shoe positioned within the window jamb, said pivot bar shoe comprising a rotatable cam and a brake, said brake configured to stop the rotation of the cam; wherein the head is positioned a distance from the window sash so as to form a space therebetween, and the brake and rotatable cam are positioned along the pivot bar between the head and sash; wherein a bottom surface of the head that faces a surface of the window sash nearest the head is configured to contact a surface of the pivot bar shoe that is most distal from the surface of the window sash.

2. The pivot bar of claim 1, wherein the window sash defines the receiver therein.

3. The pivot bar of claim 1, wherein the brake is configured to prevent minute rotation of the rotatable cam, instead requiring intentional action by the user to rotate the window sash.

4. The pivot bar of claim 1, wherein the brake is configured to prevent the rotatable cam from rotating more than 30 degrees.

5. The pivot bar of claim 1, wherein the pivot bar head is sized to be receivable within an orifice defined by the cam.

6. The pivot bar of claim 5, wherein the brake and rotatable cam are separate components.

7. The pivot bar of claim 6, wherein the pivot bar shoe further comprises a base, a first portion of said base is disposed within the window jamb and a second portion of said base is disposed within the window sash.

8. The pivot bar of claim 7, wherein the base is a separate component from the brake and rotatable cam.

9. The pivot bar of claim 8, wherein the brake is positioned at a front position of the pivot bar shoe.

10. The pivot bar of claim 7, wherein the brake circumscribes the rotatable cam.

11. The pivot bar of claim 5, wherein the brake circumscribes the rotatable cam; wherein the bottom surface of the head, the surface of the window sash, and the surface of the pivot bar shoe are all parallel with one another.

* * * * *